US010026257B2

(12) United States Patent
Hawkins et al.

(10) Patent No.: US 10,026,257 B2
(45) **Date of Patent: *Jul. 17, 2018**

(54) METHOD OF OPERATING A GAMING SYSTEM, A GAMING SYSTEM AND A GAME CONTROLLER

(71) Applicant: Aristocrat Technologies Australia Pty Limited, North Ryde (AU)

(72) Inventors: Ryan Paul Hawkins, Henderson, NV (US); Robert Honeycutt, Henderson, NV (US); Stephanie Johns, Las Vegas, NV (US)

(73) Assignee: Aristocrat Technologies Australia Pty Limited (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/274,558

(22) Filed: Sep. 23, 2016

(65) Prior Publication Data

US 2018/0089929 A1 Mar. 29, 2018

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/3246* (2013.01); *G07F 17/3251* (2013.01); *G07F 17/34* (2013.01)

(58) Field of Classification Search
None
See application file for complete search history.

(56) References Cited

U.S. PATENT DOCUMENTS 8,602,868 B2 * 12/2013 Johnson ..... G07F 17/3213 463/20
8,777,720 B2 * 7/2014 Kelly ..... G07F 17/32 463/17
2003/0027615 A1 * 2/2003 Sousumi ..... A63F 3/00643 463/14
2005/0159208 A1 * 7/2005 Pacey ..... G07F 17/3211 463/20
2006/0287036 A1 * 12/2006 Daly ..... G07F 17/3211 463/16
2011/0244943 A1 * 10/2011 Milford ..... G07F 17/3244 463/20
2013/0065663 A1 * 3/2013 Johnson ..... G07F 17/3213 463/20
2013/0102375 A1 * 4/2013 Aoki ..... G07F 17/32 463/20
2014/0094249 A1 * 4/2014 Gugler ..... G07F 17/3213 463/20

(Continued)

*Primary Examiner* — Tramar Harper
(74) *Attorney, Agent, or Firm* — McAndrews, Held & Malloy, Ltd.

(57) ABSTRACT

An electronic gaming machine and method. An initial symbol array of a predetermined size is provided, and reels are used for selecting symbols for display onto the array. There is an active region and a non-active region of the array. At least one reel includes a vertical stack of at least two rows high. If the vertical stack lands in a position overlapping the active and non-active region, the array grows to encompass the vertical stack. The outcome is determined based on the array after it has grown. In addition, a second growing occurs randomly when the vertical stack lands within the active region or overlaps the active and non-active regions.

14 Claims, 8 Drawing Sheets

(56) References Cited

U.S. PATENT DOCUMENTS

| | | | | |
|---|---|---|---|---|
| 2015/0161853 | A1* | 6/2015 | Ryan | G07F 17/34 463/20 |
| 2015/0379831 | A1* | 12/2015 | Lee | G07F 17/34 463/20 |
| 2016/0093151 | A1* | 3/2016 | Hawkins | G07F 17/3246 463/21 |

* cited by examiner

METHOD OF OPERATING A GAMING SYSTEM, A GAMING SYSTEM AND A GAME CONTROLLER

RELATED APPLICATIONS

[Not applicable]

FEDERALLY SPONSORED RESEARCH OR DEVELOPMENT

[Not Applicable]

[MICROFICHE/COPYRIGHT REFERENCE]

[Not Applicable]

BACKGROUND OF THE INVENTION

Gaming systems are known that employ stacks of symbols—i.e. groups of the same symbol arranged at contiguous symbol positions on a reel strip.

A need exists for alternative gaming systems.

BRIEF SUMMARY OF THE INVENTION

The invention provides an electronic method of operating a gaming system comprising a game controller, the method comprising:

using a display having a rectangular display area formed of display positions of rows and columns, using a set of reels each having predefined symbols, at least one of said reels having a symbolled vertical stack;

using a vertical stack of one or more symbols, the stack having a length of at least two rows high;

selecting symbols, via a random number generator, from a set of the reels for display in a predefined active region of a rectangular array in the rectangular display area and for potential display in a non-active region on the rectangular array, including the vertical stack;

determining from said selecting whether said vertical stack overlaps both the active and non-active regions;

increasing the size of the active region of the rectangular array by a number of rows of the non-active region and forming a first increased size of the array so as to maintain said vertical stack within the active region of the rectangular array;

randomly increasing the first increased size of the active region of the rectangular array by a number of rows of the non-active region and forming a second increased size of the array;

displaying on the display in the second increased size of the active region of the rectangular array the corresponding selected symbols; and making, via the game controller, an award if the selected symbols in the second increased size of the active region include a winning outcome.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
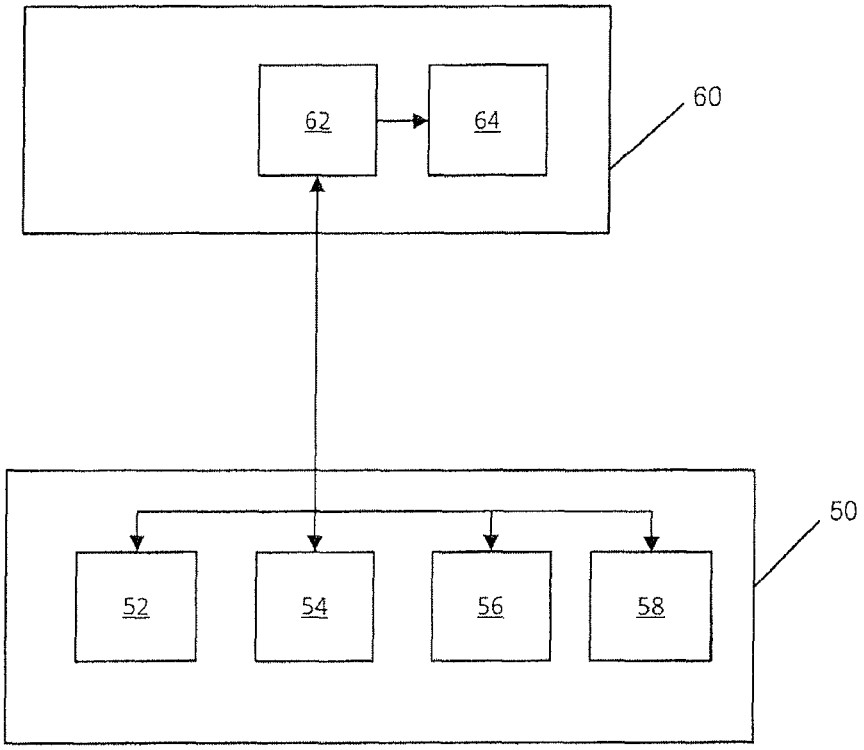
FIG. 1 is a block diagram of the core components of a gaming system.

Referring to the drawings, there is shown a gaming system having a game controller having components that enable the implementation of a method of operating a gaming system where, in an embodiment, one or more reel strips (advantageously all of the reel strips) having a vertical stack formed of a stacked number of symbols or an oversized symbol. Symbols are selected for display in an active display area which has a height in symbol display positions of a number of rows high.

The embodiment, the height of display area is randomly determined dependent on the displayed location of the vertical stack. Two random selections are used to control the height of the symbol display area.

General Construction of the Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. Player interface 50 is configured to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager and to initiate the play of a game), and one or more speakers 58.

Game controller 60 is in data communication with player interface 50 and typically includes a processor 62 that processes game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is, a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
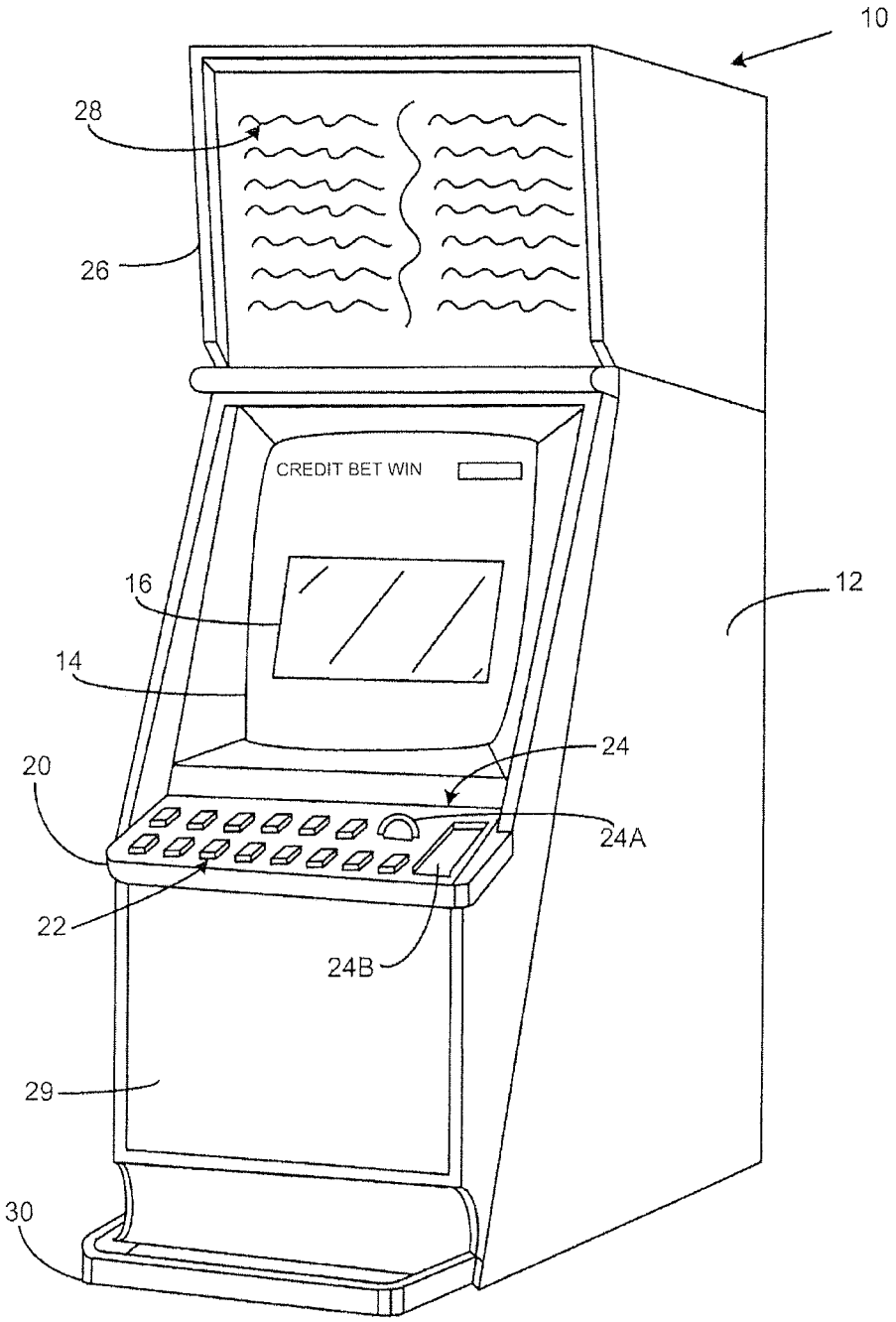
FIG. 2 is a perspective view of a standalone gaming machine.

Referring to FIG. 2, a gaming system in the form of a stand lone gaming machine 10 includes a console 12 having a display 14 on which are displayed representations of a game 16 that can be played by a player. A mid-trim 20 of gaming machine 10 houses a bank of buttons 22 for enabling a player to interact with the gaming machine, in particular during game play. Mid-trim 20 also houses a credit input mechanism 24 which, in this example, includes a coin input chute 24A and a bill collector 24B. Other credit input mechanisms may also be employed, for example, a card reader for reading a smart card, debit card or credit card. Other gaming machines may have a ticket reader for reading tickets having a value and crediting the player based on the face value of the ticket. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module that is accessed in response to insertion of the player tracking device.

A top box 26 may carry artwork 28, including for example pay tables and details of bonus awards and other information or images relating to the game. Further artwork and/or information may be provided on a front panel 29 of console 12. A coin tray 30 is mounted beneath front panel 29 for dispensing cash payouts from gaming machine 10.

Display 14 shown in FIG. 2 is in the form of a liquid crystal display. Display 14 may be any other suitable video display unit, such as an OLED display. Top box 26 may also include a display, which may be of the same type as the display 14, or of a different type.

Figure 3:
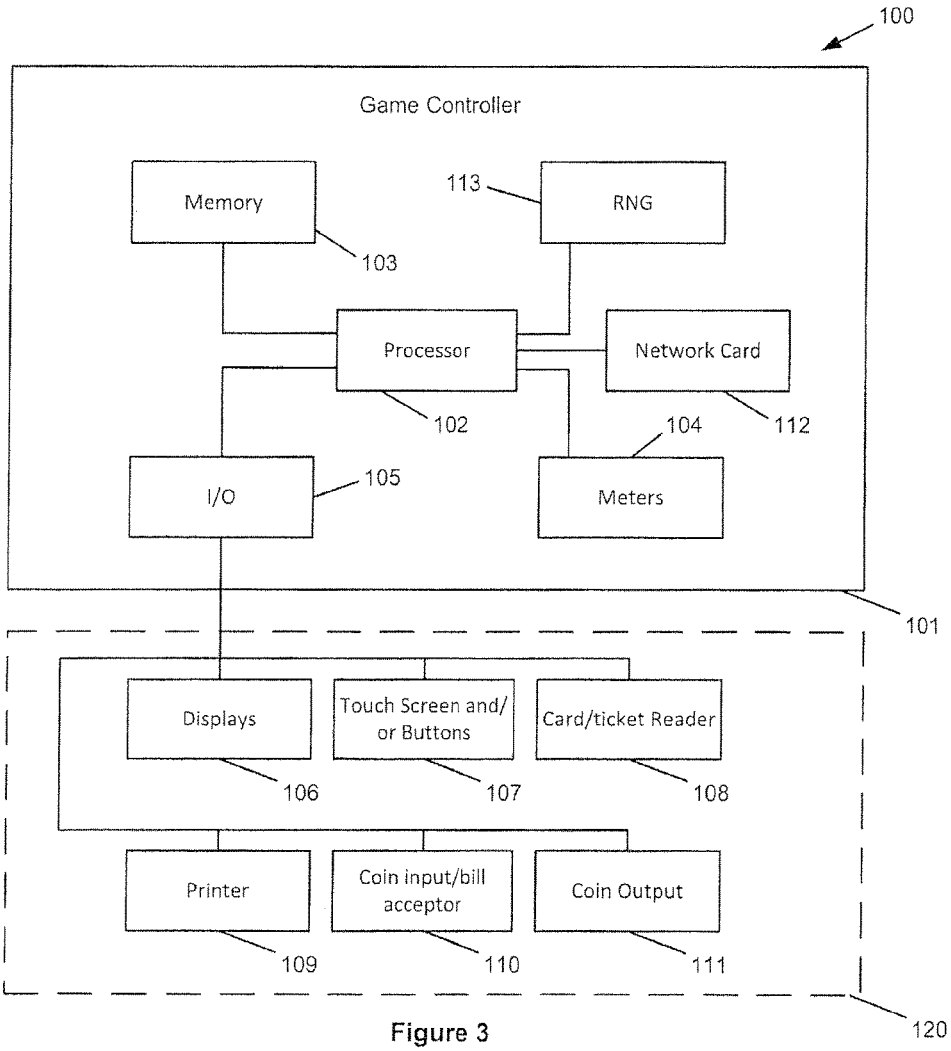
FIG. 3 is a block diagram of the functional components of a gaming machine.

Referring now to FIG. 3, a block diagram is shown of operative components of a typical gaming machine which may be the same as or different to the gaming machine of FIG. 2.

A gaming machine 100 includes a game controller 101 having a processor 102 mounted on a circuit board. Instructions and data to control operation of processor 102 are stored in a memory 103, which is in data communication with processor 102. Typically, gaming machine 100 will include both volatile and non-volatile memory and more than one of each type of memory, with such memories being collectively represented by memory 103.

Gaming machine 100 has hardware meters 104 for purposes including ensuring regulatory compliance and monitoring player credit, an input/output (I/O) interface 105 for communicating with peripheral devices of gaming machine 100. Input/output interface 105 and/or the peripheral devices may be intelligent devices with their own memory for storing associated instructions and data for use with input/output interface 105 or the peripheral devices. A random number generator module 113 generates random numbers for use by processor 102. Persons skilled in the art will appreciate that the reference to random numbers includes pseudo-random numbers.

In the example shown in FIG. 3, a player interface 120 includes peripheral devices that communicate with game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, gaming machine 100 may include a communications interface, for example a network card 112. Network card 112 may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
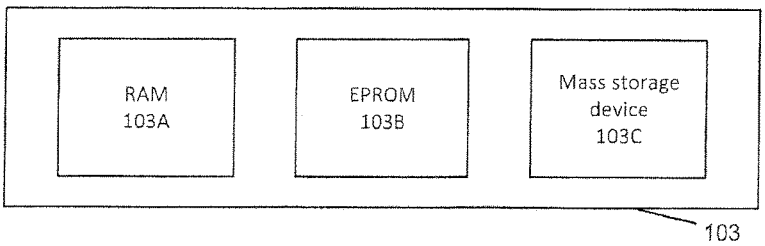
FIG. 4 is a schematic diagram of the functional components of a memory.

Referring to FIG. 4, a block diagram of the main components of an exemplary memory 103 is shown. Memory 103 includes a RAM 103A, an EPROM 103B and a mass storage device 103C. RAM 103A typically temporarily holds program files for execution by processor 102 and related data. EPROM 103B may be a boot ROM device and/or may contain some system or game related code. Mass storage device 103C is typically used to store game programs, the integrity of which may be verified and/or authenticated by processor 102 using protected code from EPROM 103B or elsewhere.

It is also possible for the operative components of gaming machine 100 to be distributed, for example input/output devices 106, 107, 108, 109, 110, 111, to be provided remotely from game controller 101.

Figure 5:
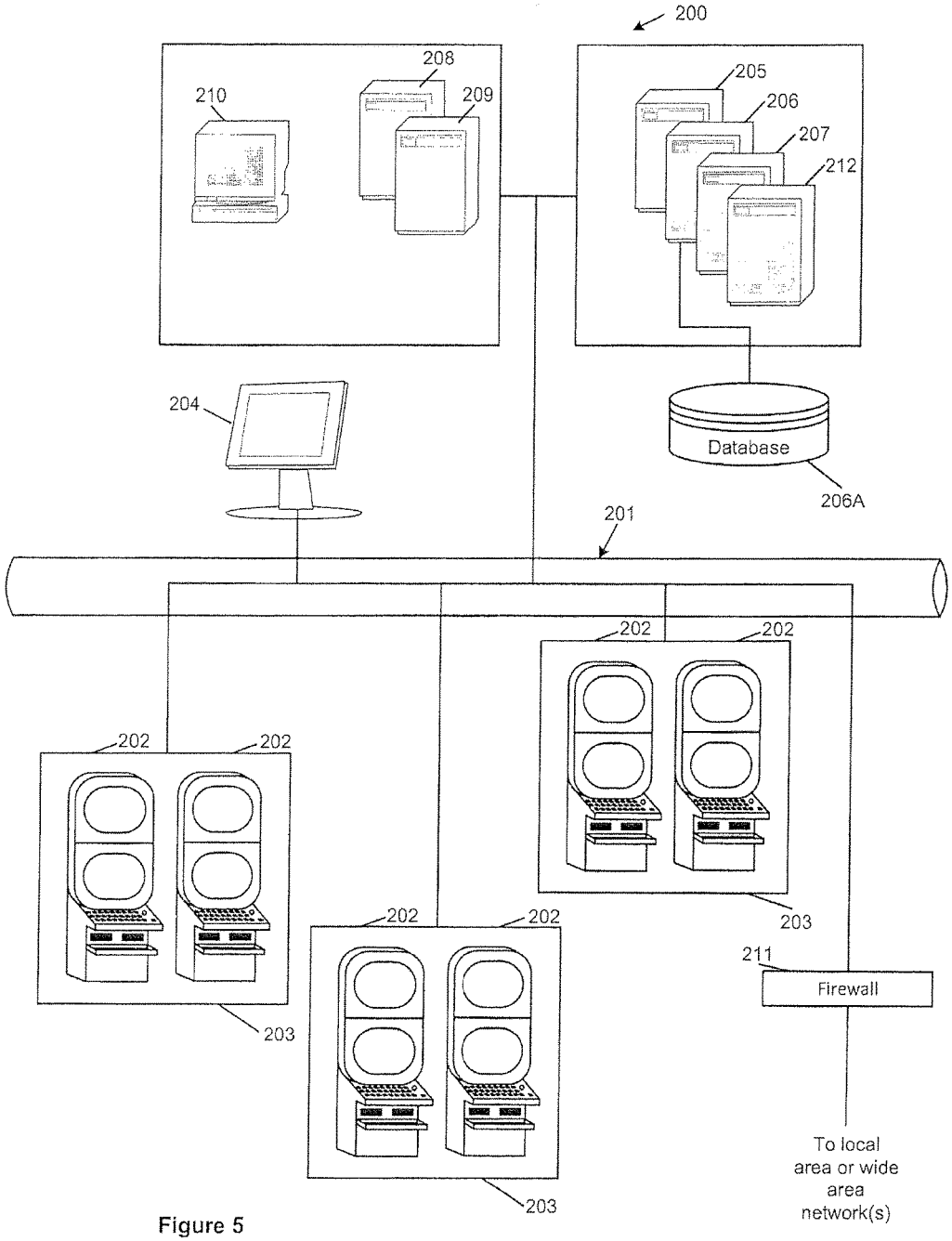
FIG. 5 is a schematic diagram of a network gaming system.

Referring to FIG. 5, a gaming system 200 is shown and is in accord with an alternative embodiment. Gaming system 200 includes a network 201, which for example may be an Ethernet network. A plurality of gaming machines 202, are shown arranged in three banks 203 of two gaming machines 202, which are connected to the network 201. Gaming machines 202 provide a player operable interface and may be the same as gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to network 201. For example, displays 204 may be associated with one or more banks 203 of gaming machines. Displays 204 may be used to display representations associated with game play on gaming machines 202, and/or used to display other representations, for example promotional or informational material.

In a thick client embodiment, a game server 205 implements part of the game played by a player using a gaming machine 202 and gaming machine 202 implements part of the game. With this embodiment, as both the game server and the gaming device implement part of the game, they collectively provide a game controller. A database management server 206 may manage storage of game programs and associated data for downloading or access by the gaming machines 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and gaming machine 202 essentially provides only the player interface. With this embodiment, game server 205 provides the game controller. Gaming machine 202 will receive player instructions, pass these to the game server which will process them and return game play outcomes to the gaming machine for display. In a thin client embodiment, gaming machines 202 could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of gaming network 200, including for example a gaming floor management server 208, and a licensing server 209 to monitor the use of licenses relating to particular games. An administrator terminal 210 is provided to allow an administrator to run network 201 and the devices connected to the network.

Gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of the Gaming System

Referring again to FIG. 1, a player operates game play mechanism 56 to specify a wager which will be made for play of the game and to initiate play of the game. Persons skilled in the art will appreciate that a player's wager can be varied from game to game dependent on player selections. In most spinning reel games, it is typical for the player's wager to be made up of a selection as to how the game outcome will be evaluated by specifying what parts of the game outcome will qualify for winning outcomes and a multiplier that will apply to each winning outcome. For example, a player's wager may be based on how many lines are played in each game—e.g. a minimum of one line up to the maximum number of lines allowed by the game (noting that not all permutations of win lines may be available for selection) and an amount per line—e.g. one, two or five credits. Winning outcomes on an activated win line may be evaluated based on a pay table that specifies the amount awarded for a one credit per line wager multiplied by the amount wagered per line.

Such win lines are typically formed by a combination of symbol display positions, one from each reel, the symbol display positions being located relative to one another such that they form a line.

In many games, the gaming machine may award winning outcomes which are not strictly limited to the lines they have selected, for example, "scatter" pays are awarded independently of a player's selection of pay lines.

Persons skilled in the art will appreciate that in other embodiments, the player may select a number of reels to play. Games of this type are marketed under the trade name "Reel Power" by Aristocrat Leisure Industries Pty Ltd and are also known as "ways" to win games. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the center row are used for non-selected reels. As a result, the total number of ways to win is determined by multiplying the number of active display positions of each of the reels, the active display positions being all display positions of each selected reel and the designated display position of the non-selected reels. As a result for five reels and fifteen display positions there are 243 ways to win.

Figure 6:
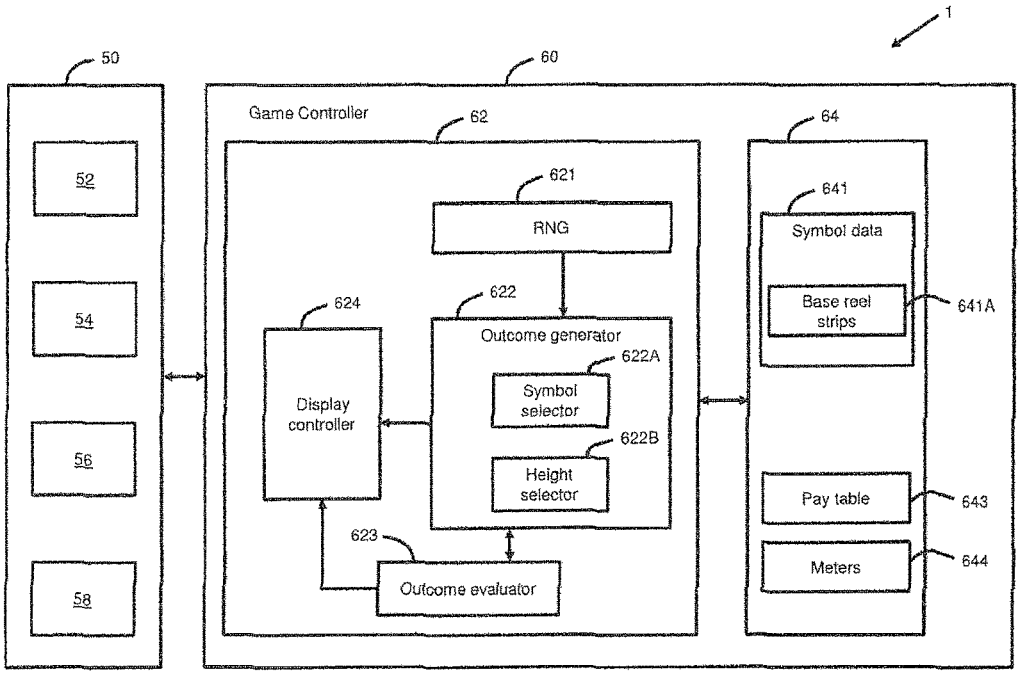
FIG. 6 is a further block diagram of a gaming system.

Referring to FIG. 6, processor 62 of game controller 60 is shown implementing a number of modules based on program code and data stored in memory 64. Persons skilled in the art will appreciate that one or more of the modules could be implemented in some other way, for example by a dedicated circuit. The particular game described below occurs as a feature game in which the game display area is caused to grow upon certain events. In the preferred embodiment, the growth will not occur in the base game.

An outcome generator 622 is configured to start spinning and then stop the reels during each play of the game. That is, each time a player places a fresh wager, the reels are spun and stopped. In this embodiment, the outcome generator 622 is also configured to begin at a predetermined height for the game play area that will be active in a feature game. In the embodiment, the height of the game area will be caused to grow (increase in game height) in the feature game depending on the display location of a vertical symbol stack. To this end, the outcome generator 622 includes a symbol selector 622A which selects the outcome of symbols for display on a 5×5 display area.

Figure 7:
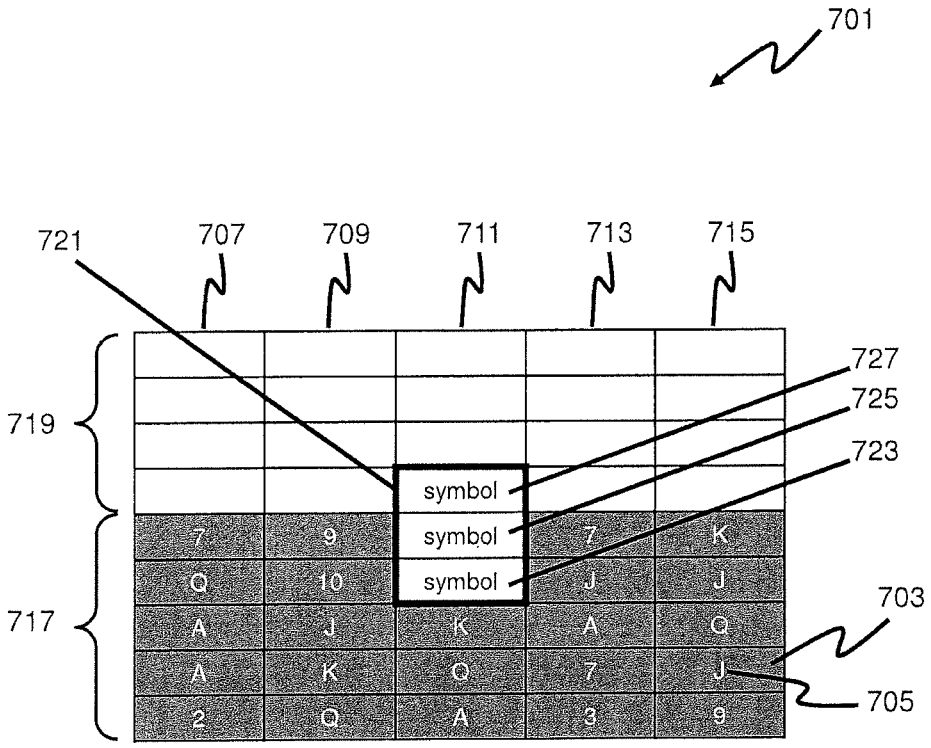
FIGS. 7-9 are diagrams of a rectangular array for display on a display of a gaming machine.

Referring to FIG. 7, an array 701 of symbols is displayed onto display device 54 (FIG. 6). Symbol positions 703 are presented in the array and are arranged in a rectangular array of rows and columns. The columns correspond to respective ones of a plurality of reels. Array 701 may be formed of different sizes. For example, the array displayed may be nine rows, and five columns, i.e., 9×5 or it may be 8×5, 7×5, 6×5 and 5×5. Each symbol display position 703 displays a single symbol 705, and thus up to forty-five (45) symbols may appear in the array 701 at its 9×5 size.

Symbols 105 are selected for display using five (5) virtual reels 707, 709, 711, 713 and 715. The five reels are spun and then stopped to reveal symbols 705 in array 703. However, the symbols 705 are only shown in a portion 717 of array 701. Portion 717 is a 5×5 array of symbol positions located as the bottom five rows of array 701. It will be appreciated that if there are five rows, the height of the active game area is five symbol positions high.

Thus twenty-five (25) symbols in the bottom five rows provide an outcome of the game. The portion 717 is referred to as an "active portion" in that only the symbols 705 in portion 717 are seen by the player for play of the game and are evaluated for an award. The remaining 4×5 portion 719 is "non-active." Non-active portion 719 is non-active in the sense that no symbols 705 are seen by the player in portion 719 and are not evaluated for awards.

Non-active portion 719 may be visually shaded dark or shown as a solid color.

As shown in FIG. 7, a vertical stack 721 of three symbols is located in display positions on center reel 711. Stack 721 may be a vertical stack of separate symbols, e.g., three of the same WILD symbols 723, 725, 727, each being placed in a symbol position 703 (although symbol 727 lies in the dark area above row five). Alternatively, stack 721 may be a single large symbol of a size to occupy three positions in a vertical stack. Vertical stack 721 is randomly positioned in the display area 701 as the third reel 711 is spun and stopped.

Figure 8:
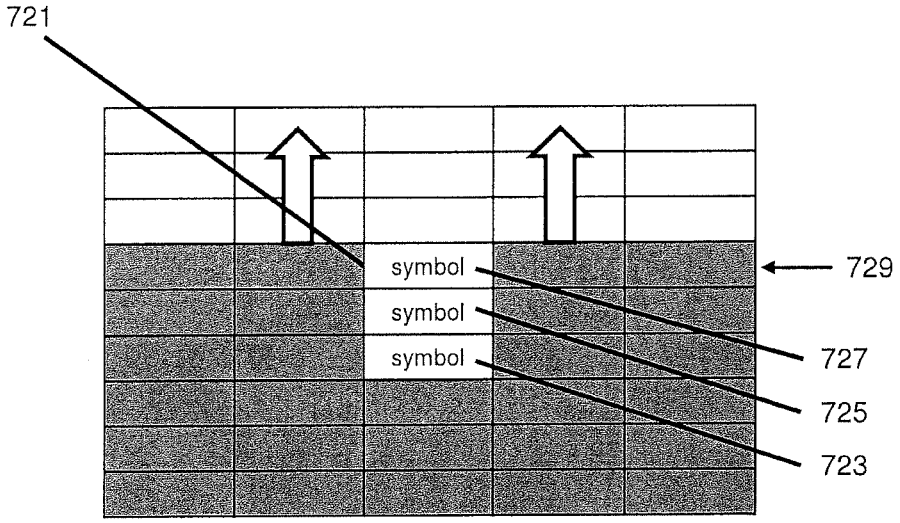

When the third reel 711 is randomly stopped and stack 721 of WILD symbols overlaps (occupies both) active area 717 and non-active area 719, active area 717 is expanded. As shown in FIG. 8, active area 717 expands or "grows" so that active area 717 includes the entire vertical stack 721. Active area 717 grows upwardly by one row, row 729, as shown in FIG. 8, so as to include the entire stack 721. Active area 717 only grows so far as necessary to include the top of the stack (including the symbol 727). Thus, active portion 727 of the array grows from a 5×5 active array (FIG. 7) to a 6×5 active array (FIG. 8).

Thus, a height selector 622B (FIG. 6) recognizes the overlap will occur and responsively adds a sixth row 729 (FIG. 8) of symbol positions with the sixth row of symbols taken from the reels. The newly grown active portion 717 of array 703 (the 6×5 active array of FIG. 8) is evaluated for awards. For example, an award may be based on a symbol combination in the newly added row 729. After the award, the active portion of the array returns to a 5×5 array for the next spin in the feature game, or to the next spin in a base game if the feature game is completed. Stack 721 may or may not again occur in an overlap area in the next spin of the feature game. Other embodiments may be formed in which, for example, a number of free spins are given to the player in the feature game, and the array 701 is allowed to grow without returning to its 5×5 size after a spin, until the number of free games has ended.

If vertical stack 721 is randomly positioned entirely above the top row of active portion 717 so that it does not overlap both the active portion 717 and non-active portion 719, the active portion 717 will not grow to obtain the vertical stack 721. For example, where a 5×5 array is being played and the vertical stack is positioned in rows 6, 7 and 8 (although not seen by the player), the array will not grow so as to include the vertical stack.

Figure 9:
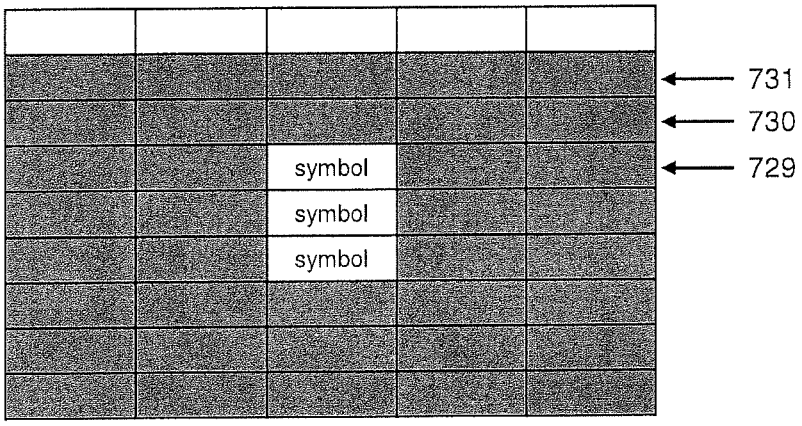

In addition to the growth caused by a vertical stack overlapping the active and non-active area, the array is caused to grow further by a random selection of a height for the array. This second growth in height is shown in FIG. 9. After the array has grown, based on the overlap, to the sixth row (FIG. 8), a row height is randomly selected from a set of possible heights, for example, a height of eight rows is randomly selected. Since the height of eight rows is higher than the grown array of six rows, the array grows to eight rows, as shown in FIG. 9. As will suggest itself, instead of selecting the height by row number (e.g., 8), a random selection of a number of rows (e.g., 2) to be added to the top of the active portion, may be made, allowing up to nine rows high.

That is, there are two growing actions. First, as shown in FIG. 8, the array grows to the top of the location of a vertical stack that overlaps both active and non-active portions 717, 719 when the reels stop (the stack then is overlapping into the non-active portion). Second, as shown in FIG. 9, a random selection is next used to determine whether the array grows further in height. The second action of random selection takes place if either (1) the vertical stack overlaps the active and non-active portion (as in FIG. 7) or the vertical stack occurs within the active portion (for example, in rows 1, 2 and 3). Thus, the second action extends the active portion of the 5×5 array (it not having been extended due to overlap, but the vertical stack occurs entirely within the 5×5 array) or further extends the active portion of, e.g., an extended 6×5 array (it having been extended to 6×5 from a 5×5 array due to overlap). As is evident, random growth occurs whenever all or part of the vertical stack turns up on the screen.

As shown in FIG. 6, outcome generator 622 includes a height selector 622B. Height selector 622B determines whether there is a vertical stack overlap based on selection by symbol selector 622A. In response to the determination of overlap, height selector 622B determines a row height which will display the top of the vertical stack within the active area. Also the height selector 622B will randomly determine whether to increase the row height. The active portion of the array will then be displayed at the determined row height via display controller 624.

With these two growth actions, the game can be set such that higher growth occurs more often. In addition, more than one vertical stack may be carried by a reel. Also, the length of a vertical stack may be varied.

As will suggest itself, the game may allow growth only with respect to some reels. For example, where the game has five reels as shown in FIG. 7, only the center three reels 709, 711, 713 are permitted to cause the array to grow. No vertical stack will be a part of the symbols in the reel strips of reels 707, and 715. Also, in some embodiments, certain events in the game may cause certain reels to be populated with vertical stacks which were not present on the reels prior to such a certain event.

Referring again to FIG. 6, symbol data 641 defines base reel strips 641A which are comprised of a number of predefined symbols including one or more vertical stacks. Further, in this embodiment of the invention, the same arrangement of stacked symbols is applied to each reel.

Symbol selector 622A selects symbols for display using random number generator 621. The selected symbols are advised to the display controller 624 which causes them to be displayed on display 54 at a set of display positions.

One example of selecting symbol's is for the symbol selector 622A to select symbols from respective ones of a plurality of spinning reels. The symbol selector 622A selects the symbols for display by selecting a stopping position in the sequence of symbols, for each reel. It is known to use a probability table stored in memory 64 to vary the odds of a particular stop position being selected. Other techniques can be used to control the odds of particular outcomes occurring to thereby control the return to player of the game.

Once symbols are selected, they are evaluated in order to determine whether they include any winning outcomes. These evaluations are made by outcome evaluator 623 based on the pay table 643 which defines the winning outcomes and associated awards.

It will be understood to persons skilled in the art of the invention that many modifications may be made without departing from the spirit and scope of the invention, in particular it will be apparent that certain features of embodiments of the invention can be employed to form further embodiments.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electronic method of operating a gaming machine comprising a game controller having a random number generator, a display having a rectangular display area formed of display positions arranged in rows and columns, a set of reels each having predefined symbols, at least one of said reels having a vertical stack of a length of at least two rows high, a credit input mechanism configured to receive a physical item representing a monetary value to establish a credit balance, the credit balance being increasable and decreasable based at least on wagering activity, a credit meter configured to monitor the credit input having been provided by the credit input mechanism, and a payout mechanism configured to provide a payout, the method comprising:

establishing a credit balance via said credit input mechanism receiving the physical item;

selecting symbols, via the random number generator in accord with the wagering activity, from the set of reels for display in individual ones of the display positions of a predefined active region of the rectangular display area and for potential display in individual ones of the display positions of a non-active region of the rectangular display area;

determining, via the game controller, from said selecting whether said vertical stack is selected and overlaps both the active region and the non-active region of the rectangular display area;

controlling, via the game controller, the display to increase the size of the active region in response to determining said vertical stack overlaps both the active region and the non-active region of the rectangular display array by adding a number of rows from the non-active region to form a first increased size of the active region so as to maintain said vertical stack entirely within the active region of the rectangular display area;

controlling, via the game controller, the display to randomly increase the size of the active region of the rectangular display area by adding a number of rows from the non-active region to the active region to form a second increased size of the active region of the rectangular display area;

displaying on the display in the second increased size of the active region of the rectangular display area the selected symbols in their respective display positions;

making, via the game controller, an award if the selected symbols in the second increased size of the active region include a winning outcome; and providing via the payout mechanism a payout based on the credit balance.

2. A method as claimed in claim 1 wherein said step of randomly increasing the size of the active region to form the second increased size occurs whether or not the size of the active region is increased to form the first increased size.

3. A method as claimed in claim 1 wherein both steps of increasing occur.

4. A method as claimed in claim 3 wherein the second increase size of the active region is larger in number of rows than said first increase size of the active region.

5. A method as claimed in claim 1 wherein the number of rows added to increase the size of the active region to the second increased size is at least equal to the row length of the vertical stack.

6. A method as claimed in claim 1 wherein said vertical stack is one symbol.

7. A method as claimed in claim 1 wherein said vertical stack is a plurality of single symbols in a stack, each said single symbol being placed in the stack to occupy one display position.

8. A method as claimed in claim 1, wherein said step of increasing the size of the active region to form the first increased size of the active region is performed prior to said step of randomly increasing the active region to form the second increased size of the active region.

9. A method as claimed in claim 1, wherein all of said reels have a vertical stack.

10. A method as claimed in claim 1, wherein said set of reels consists of five reels.

11. A method as claimed in claim 1, wherein only three reels of the five reels have a vertical stack.

12. A method as claimed in claim 1 wherein each of said three wheels are adjacent another one of said five reels.

13. A method as claimed in claim 1, wherein selecting symbols further comprises selecting sufficient symbols to populate the entire rectangular display area.

14. A method as claimed in claim 1, and wherein randomly increasing includes randomly increasing via a weighted table.

* * * * *